US007316591B2

(12) United States Patent
Ferderer

(10) Patent No.: US 7,316,591 B2
(45) Date of Patent: Jan. 8, 2008

(54) HOLDING FRAME FOR CONNECTOR MODULES

(75) Inventor: Albert Ferderer, Espelkamp (DE)

(73) Assignee: Harting Electric GmbH & Co. KG (DE)

( * ) Notice: Subject to any disclaimer, the term of this patent is extended or adjusted under 35 U.S.C. 154(b) by 0 days.

(21) Appl. No.: 11/611,460

(22) Filed: Dec. 15, 2006

(65) Prior Publication Data

US 2007/0155252 A1 Jul. 5, 2007

(30) Foreign Application Priority Data

Dec. 22, 2005 (DE) ..... 20 2005 020 026 U

(51) Int. Cl.
*H01R 13/502* (2006.01)
*H01R 13/514* (2006.01)

(52) U.S. Cl. ..... 439/701; 439/532; 439/716

(58) Field of Classification Search ..... 439/701, 439/532, 716, 717
See application file for complete search history.

(56) References Cited

U.S. PATENT DOCUMENTS 5,989,062 A * 11/1999 Daoud ..... 439/532
5,989,074 A 11/1999 Miller et al. ..... 439/709
6,004,162 A 12/1999 Harting et al. ..... 439/701
6,196,869 B1 * 3/2001 Kay et al. ..... 439/532
2003/0194914 A1 * 10/2003 Duck et al. ..... 439/701
2007/0004287 A1 * 1/2007 Marshall ..... 439/701

FOREIGN PATENT DOCUMENTS

| | | |
|---|---|---|
| DE | 197 07 120 C1 | 6/1998 |
| EP | 0 598 614 | 1/1998 |
| FR | 2 657 469 | 7/1991 |

* cited by examiner

*Primary Examiner*—Hae Moon Hyeon
(74) *Attorney, Agent, or Firm*—Hayes Soloway P.C.

(57) ABSTRACT

A one-piece holding frame formed of plastic for a plug-type connector, in which several connector modules are arranged adjacent to one another. Several wall segments with window-like openings are formed in the collar-shaped mating side of the holding frame via slots. Two wall segments that lie opposite of one another respectively form a receptacle for one connector module, wherein projections arranged on the connector modules snap into the openings of the holding frame when the connector modules are inserted into the holding frame.

3 Claims, 2 Drawing Sheets

HOLDING FRAME FOR CONNECTOR MODULES

BACKGROUND OF THE INVENTION

1. Field of the Invention

The invention pertains to a one-piece holding frame that consists of a plastic material and serves for accommodating several connector modules arranged adjacent to one another.

2. Description of the Related Art

A holding frame of this type is required for combining several connector modules with partially different mating configurations in a connector housing and to connect said connector modules to a corresponding mating connector.

DE 197 07 120 C1 discloses a mounting frame for holding connector modules, wherein this mounting frame is composed of two halves that are connected to one another in an articulated fashion, and wherein the connector modules that can be inserted into recesses in the mounting frame are held with a positive fit when the two halves are closed.

SUMMARY OF THE INVENTION

Consequently, the invention is based on the objective of realizing a one-piece holding frame of plastic of the initially cited type in such a way that already known connector modules can be reliably interlocked and held therein. This objective is attained in that the holding frame features several wall segments on its mating side that are separated from one another by slots, wherein two wall segments that are arranged symmetrically opposite of one another respectively form a receptacle for one connector module.

The advantages attained with the invention can be seen, in particular, in that a holding frame in the form of a one-piece moulded plastic part can be manufactured much easier, for example, than an articulated metallic holding frame. In addition, connector modules with electric contacts arranged therein can be inserted and interlocked in the holding frame more easily because the plastic materials slide very well on one another. To this end, the longitudinal walls of the collar-shaped holding frame on the mating side are divided into several wall segments by means of slots, wherein two wall segments that are arranged symmetrically opposite of one another respectively form a plug-in area or receptacle for one connector module.

It is also advantageous that the wall segments feature a window-like opening, above which a guide groove is arranged such that the connector modules provided with integral projections on the narrow sides can be inserted into a guide groove provided with an insertion ramp and the springable wall segments are briefly pressed outward before the projections snap into the openings.

In addition, the connector modules feature interlocking arms that are integrally moulded onto their narrow sides such that they act in the direction of the cable connection side and engage underneath the lateral collar wall when the projections snap into the openings such that two independent interlocking means fix the connector modules in the holding frame.

BRIEF DESCRIPTION OF THE DRAWINGS

One embodiment of the invention is illustrated in the figures and described in greater detail below. The figures show.

DESCRIPTION OF THE PREFERRED EMBODIMENTS

Figure 1:
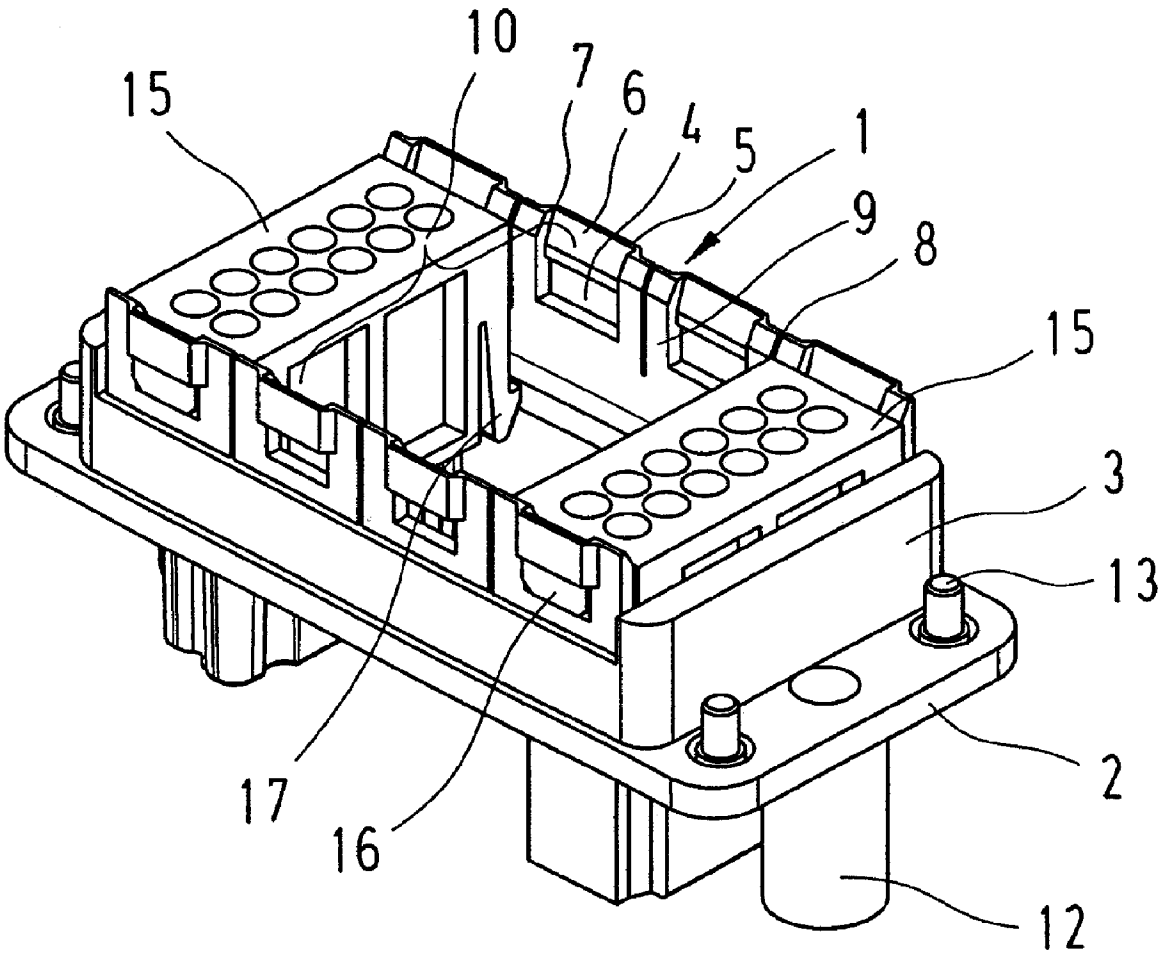
FIG. 1 is a holding frame with connector modules viewed from the mating side.

FIG. 1 shows a holding frame that is entirely made of plastic and designed for accommodating individual connector modules 15 to be inserted therein.

The holding frame features a rectangular flange-like frame 2 with a peripheral collar 3 integrally moulded thereon such that it extends perpendicular to the frame.

Window-like openings 4 are provided on the longitudinal sides, wherein the end of said openings on the mating side is formed by a window partition 5 that is outwardly offset by approximately the wall thickness.

Slots 8 are provided to both sides of the openings 4 and extend approximately to the center of the collar height such that they respectively form an elastic wall segment 9.

Two oppositely arranged wall segments 9 respectively form a receptacle 10 for one connector module.

When a connector module 15 is inserted into a receptacle 10 in the holding frame 1, the projections 16 arranged on the narrow sides of the connector module are initially inserted into the insertion ramps 6 of the guide grooves 7 such that the respectively opposite wall segments 9 are bent outward until the projections 16 snap into the window-like openings 4 and the wall segments spring back.

Interlocking arms 17 are also integrally moulded onto the narrow sides of the connector modules 15 and pressed together along the wall segments 9 when a connector module is inserted into the holding frame from the mating side, wherein said interlocking arms encounter an enlarged opening underneath the collar 3 that is formed by the flanged frame 2 situated underneath the collar such that the interlocking arms 17 are interlocked with the lower edge of the collar once they unbend outward. The modules therefore are secured in the holding frame by means of two independent interlocking means.

Figure 2:
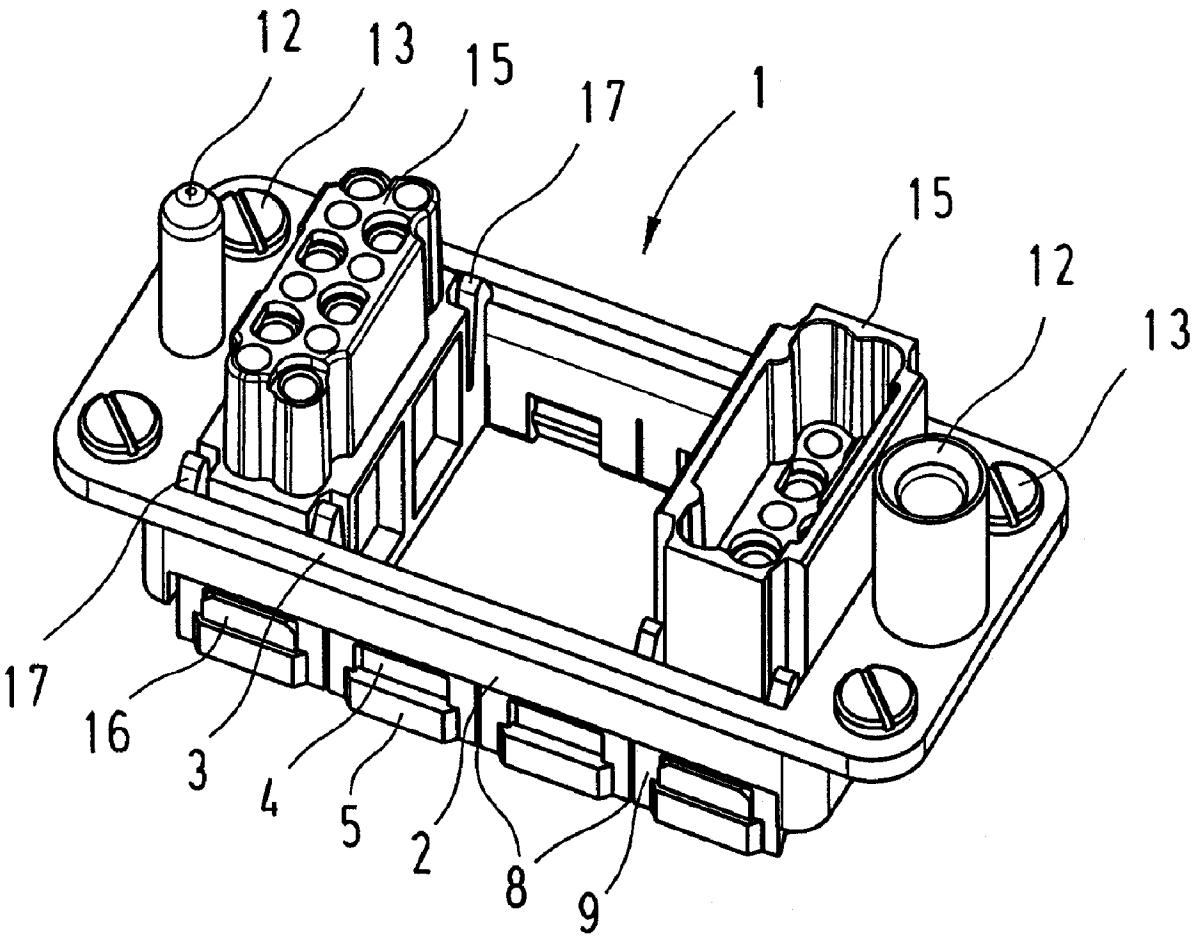
FIG. 2 is the holding frame with connector modules viewed from the cable connections.

FIG. 2 shows the holding frame with two interlocked connector modules in the form of a view from the connection side.

Two encoding elements 12 realized in the form of a pin and a socket are arranged on the surfaces of the narrow sides of the frame-shaped flange 2 in order to ensure the non-interchangeable mating with a correspondingly designed mating connector.

On the outer edges of the flange, four screw elements 13 can be inserted into openings on the narrow sides, wherein said screw elements feature pins that penetrate the flange and serve for fixing the holding frame in a not-shown connector housing.

This figure also shows the interlocking of the connector modules, wherein the hook-shaped interlocking arms 17 are interlocked in the enlarged inner recess with the edge of the collar situated thereunder.

What is claimed is:

1. A holding frame comprised of a plastic material for accommodating several connector modules that are arranged adjacent to one another, wherein the holding frame features several wall segments on its mating side that are separated by slots, wherein two wall segments that are arranged symmetrically opposite one another respectively form a receptacle for one connector module; and wherein each wall segment features a guide groove having a tapered portion forming a guide ramp; and wherein each wall segment features a window-like opening below said guide groove.

2. The holding frame according to claim 1, having one or more connector modules inserted into said receptacle, wherein said connector modules have protrusions for mating with said window-like openings.

3. The holding frame according to claim 2, having one or more connector modules inserted into said receptacle, wherein said protrusions align with said guide ramps, whereupon wall segments bend outward as the connector module is inserted until said projections mate with said window-like opening, whereupon said wall segments spring back to their original position.

* * * * *